US005392060A

United States Patent [19]

Imakawa

[11] Patent Number: 5,392,060

[45] Date of Patent: Feb. 21, 1995

[54] HALF TONE LASER RECORDING APPARATUS

[75] Inventor: Susumu Imakawa, Yokohama, Japan

[73] Assignee: Ricoh Company, Ltd., Tokyo, Japan

[21] Appl. No.: 922,761

[22] Filed: Jul. 31, 1992

[30] Foreign Application Priority Data

Aug. 2, 1991 [JP] Japan ..... 3-193780

[51] Int. Cl.[6] ..... B41J 2/435

[52] U.S. Cl. ..... 347/240; 358/298; 341/131

[58] Field of Search ..... 346/1.1, 76 L, 107 R, 346/108, 160; 358/296, 300, 302, 298

[56] References Cited

U.S. PATENT DOCUMENTS 4,566,042 1/1986 Cahill ..... 358/300
4,958,233 9/1990 Okino ..... 346/108
5,283,658 2/1994 Hayashi et al. ..... 358/296

FOREIGN PATENT DOCUMENTS 59-112763 6/1984 Japan .

*Primary Examiner*—Mark J. Reinhart

*Attorney, Agent, or Firm*—Oblon, Spivak, McClelland, Maier & Neustadt

[57] ABSTRACT

A laser recording recording apparatus including a semiconductor laser as a light source and enabling half-tone recording. The apparatus includes a recording medium moving in a sub-scanning direction, M semiconductor lasers arranged along the sub-scanning direction at a slight distance to one another and enabled to be independently modulated according to image signals, where M is an integral number of at least two, a deflector for deflecting M laser beams emitted from the M semiconductor lasers toward the recording medium and for scanning the beams in a main scanning direction, and an image forming optical system for imaging the deflected laser beams at a predetermined distance between one another along the sub-scanning direction. An exposure pattern on the recording medium is represented by a pixel matrix comprising N×L micro pixels, where N is the number of micro pixels with respect to said main scanning direction and L is the number of micro pixels with respect to the sub-scanning direction, and the exposure pattern is varied according to a density information included in the image signal thereby to record half-tone, where L is an integral number of times M.

15 Claims, 9 Drawing Sheets

DENSITY LEVEL 1

DENSITY LEVEL 2

DENSITY LEVEL 3

DENSITY LEVEL 4

DENSITY LEVEL5

DENSITY LEVEL6

DENSITY LEVEL7

DENSITY LEVEL8

DENSITY LEVEL9

DENSITY LEVEL 1

DENSITY LEVEL 2

DENSITY LEVEL 3

DENSITY LEVEL 4

DENSITY LEVEL 5

DENSITY LEVEL 6

DENSITY LEVEL 7

DENSITY LEVEL 14

DENSITY LEVEL 15

DENSITY LEVEL 1

DENSITY LEVEL 2

DENSITY LEVEL 3

DENSITY LEVEL 4

DENSITY LEVEL 5

DENSITY LEVEL 6

DENSITY LEVEL 7

DENSITY LEVEL 8

DENSITY LEVEL 9

HALF TONE LASER RECORDING APPARATUS

BACKGROUND OF THE INVENTION

1. Field of the Invention

The present invention relates to a laser recording apparatus, in particular, to an apparatus including a semiconductor laser as a light source and permitting half tone recording, such as a digital copy machine or a laser printer.

2. Description of the Related Art

These days, a laser printer incorporated with electrophotographic technology and laser scanning technique has rapidly spread as a computer output device or a digital copy machine, since in such an apparatus, ordinary paper can be used and an image of high quality can be obtained at high speed.

A conventional laser scanning optical system is shown in FIG. 1. A laser beam 2 emitted from a semiconductor laser 1 and modulated according to image signals is reflected through a lens 3 on a surface of a rotating polygon mirror 4, thereby to form an image as a micro spot on a photosensitive body 6 through an image forming lens 5. This micro spot is two-dimensionally scan exposed on the photosensitive body 6 with the rotations of the polygon mirror 4 and the photosensitive body 6 to form an electrostatic latent image. A light-intercepting element 7 for controlling the start position of image writing in a main scanning direction is placed outside the range of an image at the scanning start position side thereof on a scanning line.

To realize an optical system outputting copies of a picture of A4-size at the rate of 100 sheets/min in the laser printer as above, the peripheral velocity of the photosensitive body 6 should be 500 mm/sec and the revolution number R(rpm) of the polygon mirror 4 is computed in the following formula;

$$R = Vo \times DPI \times 60/(25.4 \times n)$$

where Vo is the rotating velocity of the photosensitive body 6, DPI is the number of recorded dots/inch, generally between 300 and 400, and n is the number of reflecting surfaces, generally between 6 and 10. Substituting now Vo, DPI and n for 500, 300 and 8 respectively in the above formula, the revolution number R of the polygon mirror 4 comes to 44,291.

In reality, however, for the polygon mirror with such a revolution number, conventional ball bearings cannot be used as a bearing for supporting a rotation axis, and consequently specific bearings such as fluid bearings and magnetic bearings are required, which causes a cost increase. In addition, since the modulation frequency of the laser 1 as a light source becomes higher, accelerated data transferring from a laser control circuit and a host machine is needed, which also causes a cost increase.

There is an alternative method of accelerating data transfer in which laser beams from a plurality of light sources are deflection scanned on the surfaces of a rotating polygon mirror to make simultaneous recordings for a plurality of lines. Scanning with a plurality of laser beams, when the number of laser beams is M, reduces the revolution number of the above polygon mirror and the laser modulation frequency to 1/M, which results in a steep cost-down.

As an example, a recording apparatus is disclosed in the Japanese Patent Application Laying Open (KOKAI) No. 59-112763. The apparatus having a semiconductor laser array, as a light source, consisting of a plurality of semiconductor lasers includes an optical system for forming images on a recording body of adjacent points of the cross-sectional forms of emitting beams from respective semiconductor lasers and a driving circuit for independently driving respective semiconductor lasers, thereby to enable a batch scanning of laser beams from a plurality of semiconductor lasers.

However, in a conventional optical system with one laser beam, the beam comes onto a rotating polygon mirror vertically in a sub-scanning direction with respect to the reflecting surface of the mirror, while in an optical system scanning a plurality of beams on one and the same rotating polygon mirror, the laser beams are emitted onto the reflecting surface of the mirror at a slight angle. Consequently, on the scanning surface (a recording body) a plurality of scanning lines become curved in the sub-scanning direction as illustrated in FIG. 2. The curvature of a scanning line increases, as an incident angle of the beam on the polygon mirror with respect to the scanning surface thereof is shifted farther from the vertical, that is, a beam nearer either side of the beam group simultaneously scanned (as a beam is shifted farther from an optical axis of a lens diameter) has bigger curvature in the scanning line thereof.

Therefore, when a recording is made in such an optical system, a pitch of a scanning line fluctuates at every period consisting of the number of light sources (the number of semiconductor lasers). These pitch fluctuations are actualized as unevenness of exposure on a recording medium and as unevenness of density on an image.

Such unevenness of density is not so noticeable in binary images such as a letter, however, when an exposure pattern is varied (varying the number of dots, the duration of lighting a light source laser and the emission power of a laser) according to the shade of an image within a dot matrix consisting of a plurality of micro pixels (dots) to make half-tone recording, unevenness of density called banding occurs, which causes gross deterioration of image quality.

SUMMARY OF THE INVENTION

Accordingly, it is an object of the present invention to provide a laser recording apparatus enabling the quality of half-tone recording to improve.

The above-mentioned object of the present invention is achieved by a laser recording apparatus including a recording medium moving in a sub-scanning direction, M semiconductor lasers arranged along the sub-scanning direction at a slight distance to one another and enabled to be independently modulated according to image signals, wherein M is an integral number of at least two, a deflector for deflecting M laser beams emitted from M semiconductor lasers toward the recording medium and for scanning the beams in a main scanning direction, and an image forming optical system for imaging deflected M laser beams spaced at a predetermined distance between one another along the sub-scanning direction. In the apparatus, an exposure pattern on the recording medium is represented by a pixel matrix consisting of N×L micro pixels wherein N is the number of micro pixels with respect to the main scanning direction and L is the number of micro pixels in the sub-scanning direction and the exposure pattern is varied according to the density information included in the image signals thereby to record half-tone, where L is an integral number of times M.

According to the present invention, the number L of the micro pixels with respect to a sub-scanning direction in the pixel matrix for half-tone recording is an integral number of times the number M of semiconductor lasers of the semiconductor laser array. Consequently, a pixel area in each pixel matrix can be retained as it is, even if pitch fluctuations in scanning lines caused by the curvature of a scanning line occur, so that an image of uniform density and free of unevenness of density with respect to the sub-scanning direction can be obtained, resulting in the improved quality of half-tone recording.

DESCRIPTION OF THE PREFERRED EMBODIMENTS

Figure 1:
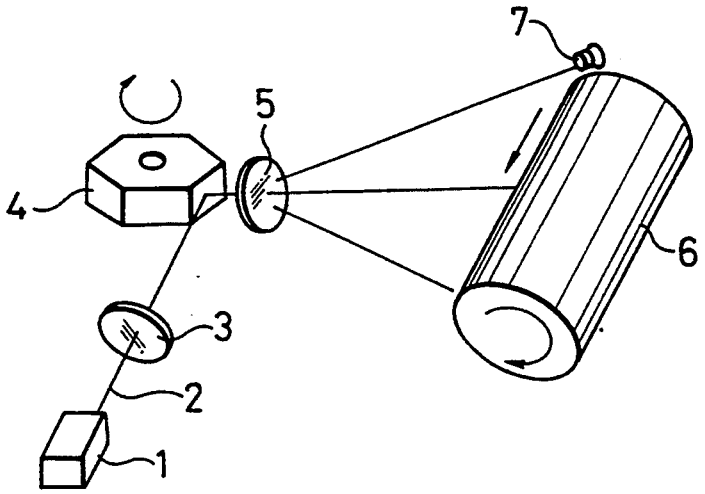
FIG. 1 is a schematic perspective view of a conventional scanning optical system.
Figure 2:
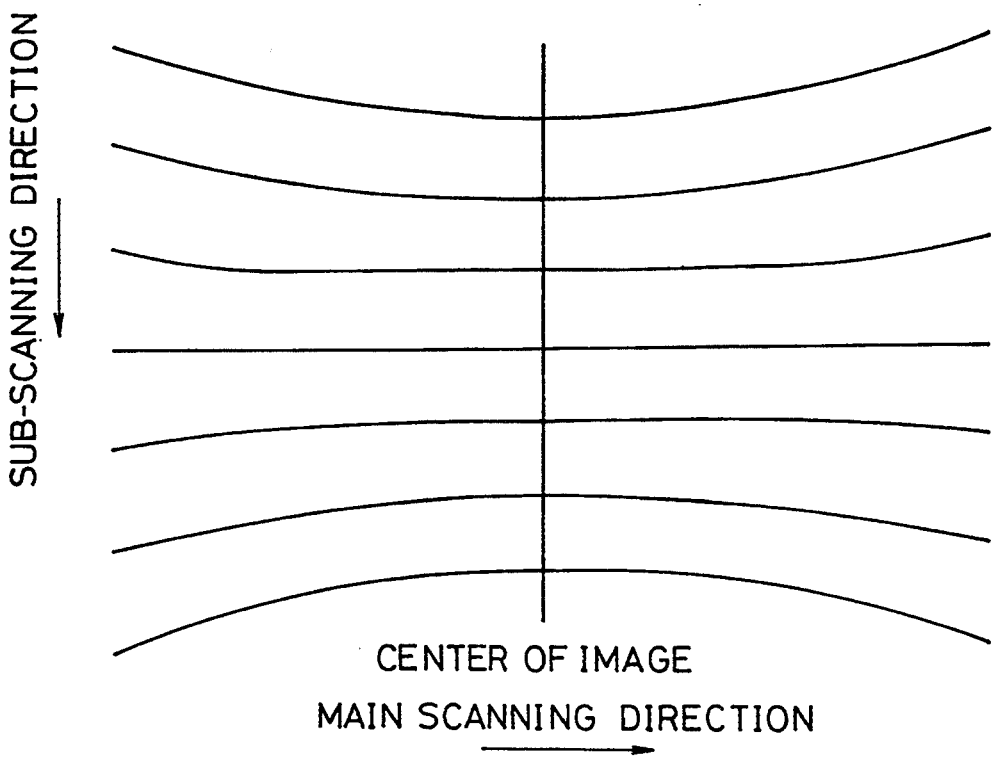
FIG. 2 is an explanatory view illustrating the condition of scanning lines.
Figure 3:
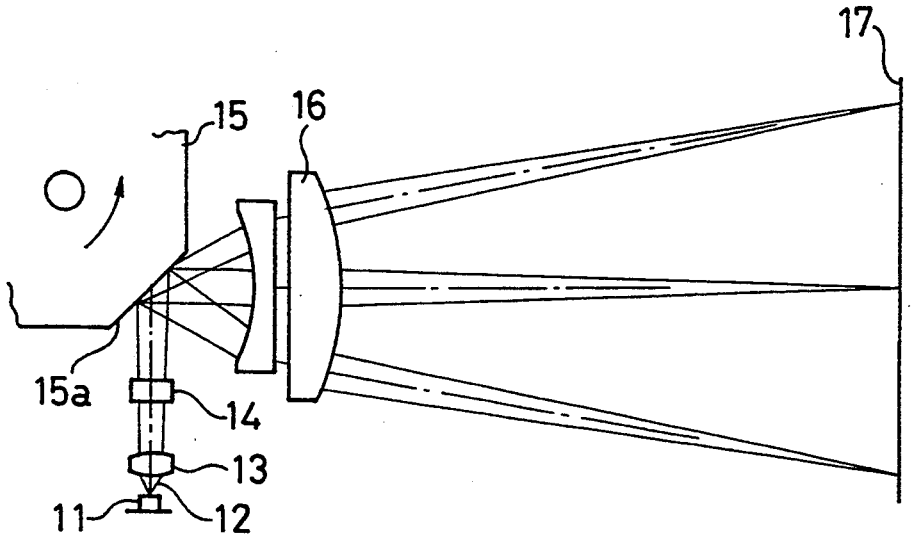
FIG. 3 is a plan view of the structure of a scanning optical system.

Referring now to the drawings 3 to 4, the first embodiment according to the present invention will be described hereinafter. FIGS. 3 and 4 show a scanning optical system in a laser recording apparatus to which the present invention is applied.

Figure 4A:
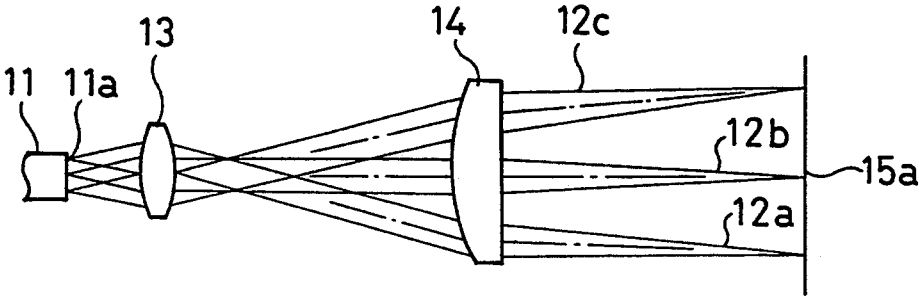
FIGS. 4*a* and 4*b* are explanatory views along a main scanning direction of the first embodiment according to the present invention.
Figure 4B:
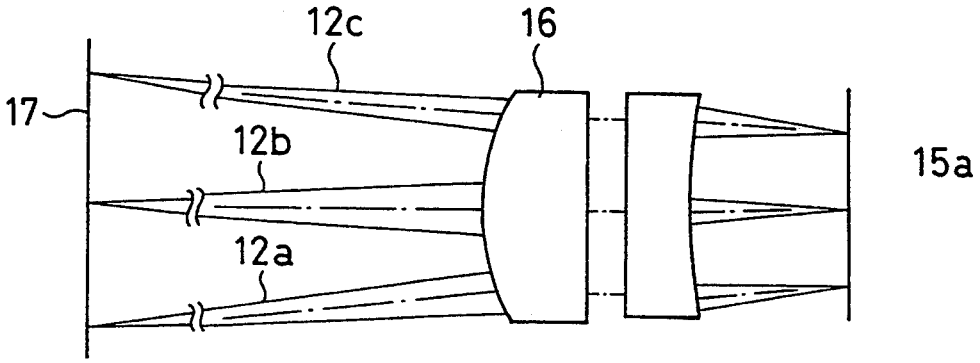

FIG. 3 is an explanatory view along a sub-scanning direction of an embodiment according to the present invention and FIGS. 4*a* and 4*b* are explanatory views along a main scanning direction of the embodiment.

A semiconductor laser array 11 is provided as a light source. As shown in FIG. 4*a*, the laser array 11 includes three luminescence centers of semiconductor lasers 11*a*, 11*b* and 11*c*. The number of semiconductor lasers may be greater than three. Laser beams 12*a* to 12*c* emitted from the lasers 11*a* to 11*c* are converted to parallel luminous flux by means of one and the same collimator lens 13 and are then focussed in the vicinity of the reflecting surface 15*a* of a rotating polygon mirror 15. The polygon mirror 15 acts as a deflector.

At this instance, the laser beam 12*b* from the laser 11*b* positioned on the optical axis as shown in FIG. 4*a* is emitted at a normal angle to the reflecting surface 15*a*, while other beams 12*a* and 12*c* are emitted onto the surface 15*a* at slight angles and slightly apart from the beam 12*b* causing the curved scanning lines as described in the conventional art. The laser beams 12*a* to 12*c* deflection scanned with the revolution of the polygon mirror 15 are focussed as micro spots onto a recording medium 17 through an image forming lens (an image forming optical system) 16 generally called f$\theta$ lens, such that the laser beams 12*a* to 12*c* are converted to scanning line pitches according to respective recording densities (FIG. 4*b*).

The lens 16 is an anamorphic lens in which the focal distances therethrough differ respectively with respect to a main scanning direction and a sub-scanning direction and which is designed such that the reflecting surface 15*a* of the polygon mirror 15 and the recording medium 17 establish a conjugate relation in the geometrical optics with respect to the sub-scanning direction. The purpose of designing as above is to constitute a supplementary optical system for reducing pitch fluctuations between scanning lines caused by angle errors (the inclination of the reflecting surface 15*a*) of the reflecting surface 15*a* of the polygon mirror 15 with respect to the rotation axis.

A cylinder lens 14 functions to adjust a beam diameter with respect to the sub-scanning direction on the recording medium 17 to make a proper spot diameter.

Figure 5A:
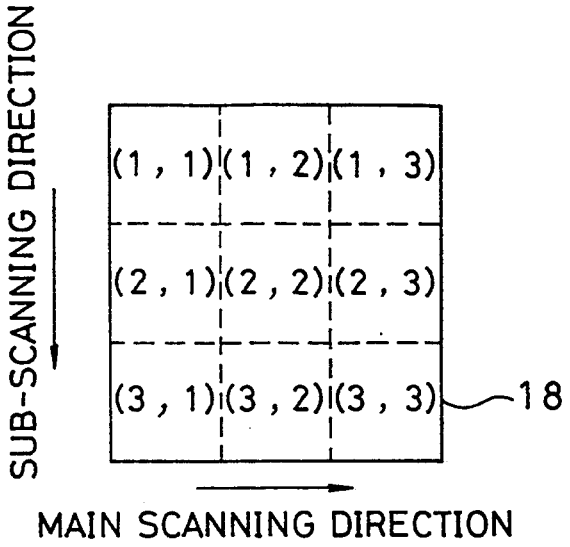
FIG. 5*a* is a block diagram of a pixel matrix of the first embodiment according to the present invention.

Half-tone recording in the basic structure as above will be described hereinafter. The structure of a pixel matrix 18 consisting of micro pixels (dots) is shown in FIG. 5*a* and examples of exposure patterns according to respective density levels are shown in FIGS. 6*a* to 6*i* in which a screened pixel part represents an exposed part.

Figure 5B:
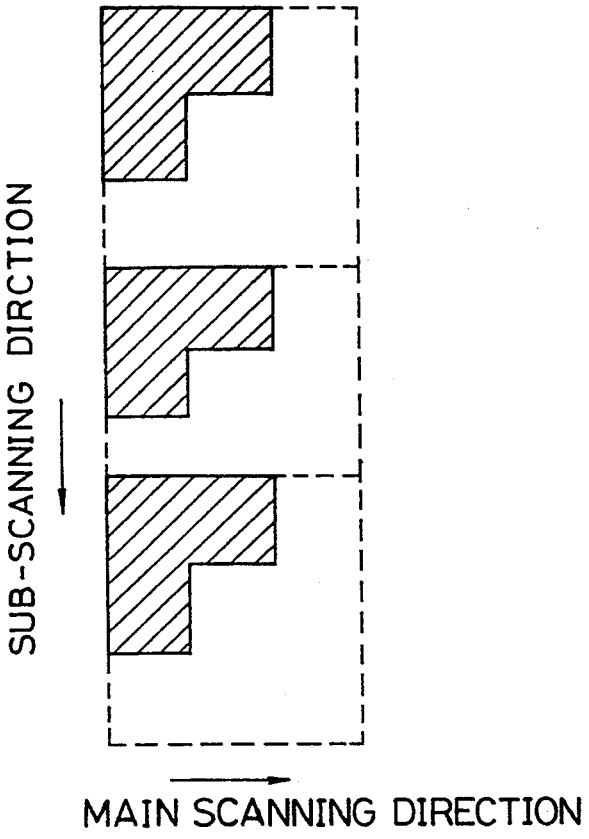
FIG. 5*b* is an explanatory diagram of a recording example according to the first embodiment of the present invention.
Figure 6A:
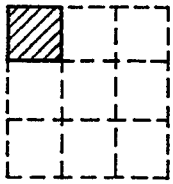
FIGS. 6*a* to 6*i* are explanatory diagrams of exposure patterns according to respective density levels.
Figure 6B:
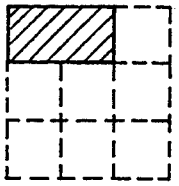
Figure 6C:
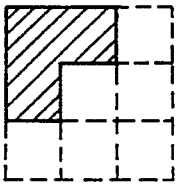
Figure 6D:
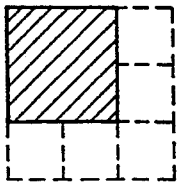
Figure 6E:
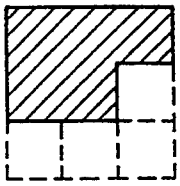
Figure 6F:
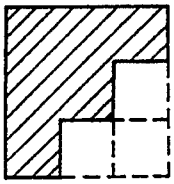
Figure 6G:
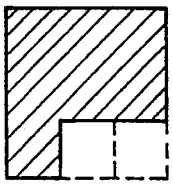
Figure 6H:
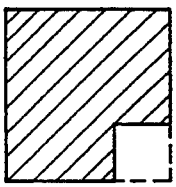
Figure 6I:
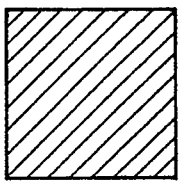

The illustrated examples show the case where three lines are simultaneously recorded with the laser array 11 consisting of the lasers 11*a* to 11*c* as illustrated in FIGS. 4*a* and 4*b* in which the matrix size is $3\times3$. When the laser beam 12*b* from the central laser 11*b* among three lasers 11*a* to 11*c* passes along the optical axis in the sub-scanning direction of the image forming optical system, the central scanning line constituting the pixel matrix 18 has no curvature since the laser beam 12*b* is emitted vertically onto the reflecting surface 15*a* of the polygon mirror 15, whereas in the other scanning lines from the beams 12*a* and 12*c* curvatures occur. In this embodiment, however, the number of pixels $L=3$ with respect to the sub-scanning direction constituting the pixel matrix 18 is the same (one of the integral numbers of times) as the number of semiconductor lasers $M=3$ in the laser array 11, therefore, even if pitch fluctuations caused by scanning line curvatures of scanning lines occur, a pixel area in each pixel matrix can be retained as it is, thereby to obtain an image with uniform density. FIG. 5*b* shows a recording example using the density level 3 selected from density patterns illustrated in FIGS. 6*a* to 6*i*. In the first embodiment, L may be at least twice as much as M.

Figure 7:
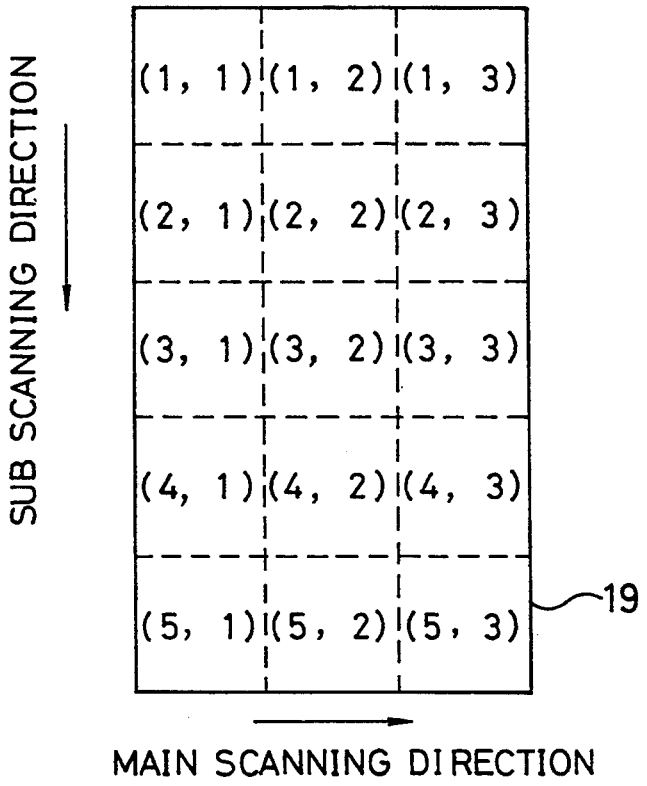
FIG. 7 is a block diagram of a pixel matrix illustrating the second embodiment according to the present invention.
Figure 8A:
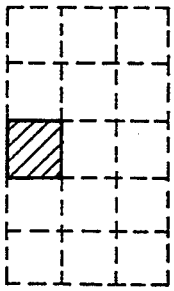
FIGS. 8*a* to 8*i* are explanatory diagrams of exposure patterns according to respective density levels.
Figure 8B:
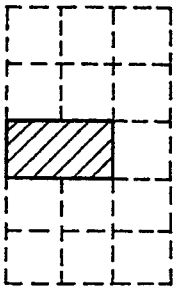
Figure 8C:
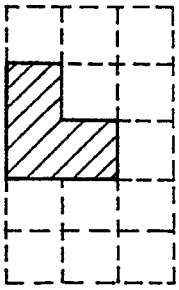
Figure 8D:
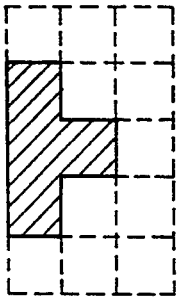
Figure 8E:
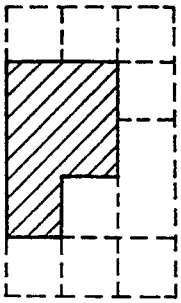
Figure 8F:
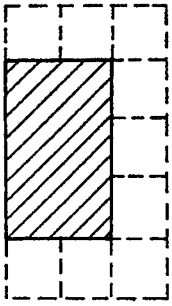
Figure 8G:
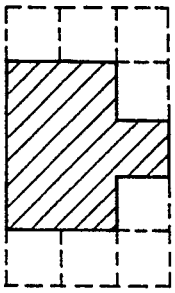
Figure 8H:
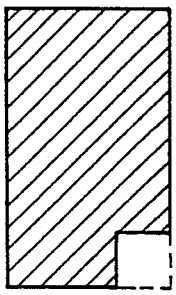
Figure 8I:
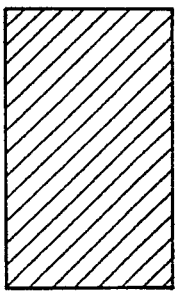

Referring now to FIG. 7 and FIGS. 8*a* to 8*i*, the second embodiment according to the present invention will be described hereinafter. In this embodiment which includes a semiconductor laser array consisting of five semiconductor lasers as a light source and in which five scanning lines of five lasers are recorded simultaneously, the structure of a pixel matrix 19 is $5\times3$ ($L=M=5$) as shown in FIG. 7. In the second embodiment, L may be at least twice as much as M.

The central laser among 5 semiconductor lasers is disposed to pass along the optical axis in a sub-scanning direction of an image forming optical system. Also, part of examples for exposure patterns according to respective density levels are shown in FIGS. 8*a* to 8*i* in which the diagrams for the density levels 8 to 13 are omitted.

Also in this case, no curvature occurs, since the central scanning line constituting the pixel matrix 19 is emitted vertically onto a reflecting surface of a polygon mirror, while curvatures occur in the other scanning lines. However, a pixel area is retained without being affected by pitch fluctuations caused by scanning line curvatures and an image with uniform density with respect to the sub-scanning direction is thus obtained as in the above-mentioned embodiment, since the number M of semiconductor lasers is the same as the number L of micro pixels with respect to the sub-scanning direction in the pixel matrix 19.

In addition, in this embodiment as shown in FIGS. 8*a* to 8*i*, the central one among micro pixels of the pixel matrix 19 with respect to the sub-scanning direction is first exposed [in detail, micro pixels (3,1) shown in FIG. 7] as the density level increases, therefore the micro pixels with small curvature in the central area with respect to the sub-scanning direction are solely employed in the case of lower density levels, which reduces the fluctuations of the pixel area between the central part and the edge part of an image.

Figure 9A:
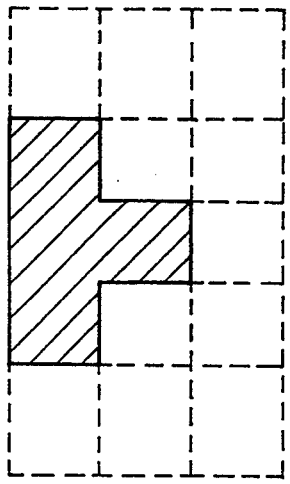
FIGS. 9*a* and 9*b* are explanatory diagrams illustrating a recording example.
Figure 9B:
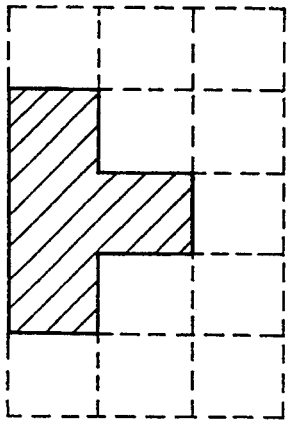
Figure 10A:
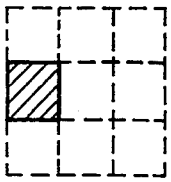
FIGS. 10*a* to 10*i* are explanatory diagrams of exposure patterns illustrating the third embodiment according to the present invention.
Figure 10B:
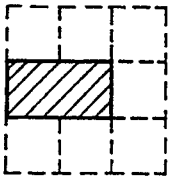
Figure 10C:
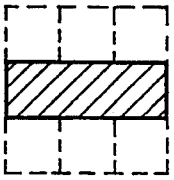
Figure 10D:
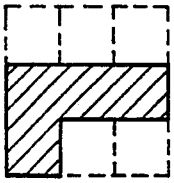
Figure 10E:
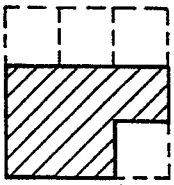
Figure 10F:
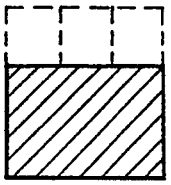
Figure 10G:
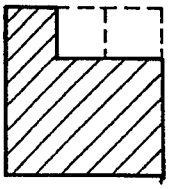
Figure 10H:
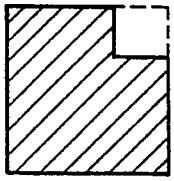
Figure 10I:
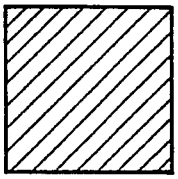

FIGS. 9*a* and 9*b* show a recording example taking the density level 4 as an example in which FIG. 9*a* shows a recording example in the edge part of an image with respect to the main scanning direction and FIG. 9*b* shows a recording example in the central part of an image with respect to the main scanning direction. As shown in this example, unevenness of density with respect to the sub-scanning direction is reduced in lower density levels.

The third embodiment according to the present invention will be hereinafter described with reference to FIGS. 10*a* to 10*i* and FIGS. 11*a* and 11*b*. In this embodiment, when a light source is consisted of three semiconductor lasers 11*a* to 11*c* as shown in FIG. 4*a*, the exposure patterns according to respective density levels are schemed as shown in FIGS. 10*a* to 10*i* in the structure of a pixel matrix 18 as shown in FIG. 5*a*. That is, as the density level rises (density levels 1 to 3), the exposure patterns of the pixel matrix 18 are arranged to subsequently expose in the main scanning direction the central pixels with respect to the sub-scanning direction [the pixel (2, 1), (2, 2), (2, 3) in FIG. 5*a*] taking precedence, and after the completion of exposing the micro pixel in to the main scanning direction, adjoining pixels with respect to the sub-scanning direction [the pixels (3, 1), (3, 2), (3, 3) in FIG. 5*a*] are subsequently exposed in the main scanning direction (density levels 4 to 6). After the micro pixels with respect to the main scanning direction are also exposed, adjoining pixels on the other side [the pixels (1, 1), (1,2), (1,3) in FIG. 5*a*] are subsequently exposed in the main scanning direction (density levels 7 to 9). In the third embodiment, L may be at least twice as much as M.

Figure 11A:
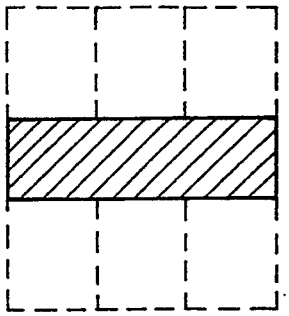
FIGS. 11*a* and 11*b* are explanatory diagrams illustrating a recording example.
Figure 11B:
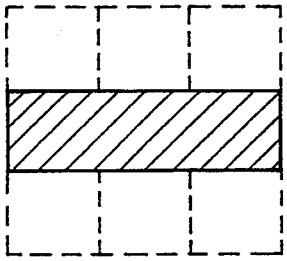

According to the above embodiment, at a lower density level, only micro pixels with small scanning line curvature in the central area with respect to the sub-scanning direction are used as the exposure patterns with first priority, therefore, taking the density level 3, for example, the exposure pattern results in that of the recording example with small fluctuations in the pixel areas as illustrated in FIGS. 11*a* and 11*b* wherein FIG. 11*a* represents the edge part of the image and FIG. 11*b* represents the central part of the image. Whereby, unevenness of density with respect to the sub-scanning direction is further decreased than in the second embodiment.

Each embodiment described above explains exclusively the case where micro pixels are recorded with binary, however, it can be also applied to a laser recording apparatus in which laser lighting time or laser power is changed to make a multi-value per dot recording.

Also, the illustrated pixel matrices 18, 19 are determined respectively as $3\times3$ and $5\times3$ in size, however, any other proper sizes in addition to the above sizes can be applicable.

The invention has been described in detail with particular reference to the preferred embodiments thereof, however, it will be understood that variations can be effected within the spirit and scope of the invention.

What is claimed is:

1. A laser recording apparatus comprising:

a transporting means for transporting a recording medium in a sub-scanning direction;

M semiconductor lasers arranged along said sub-scanning direction at a slight distance to one another, M being an integral number from two to sixteen;

a converting means for converting an image information into a recording information comprising a plurality of pixel data each having a density data;

a deflector for deflecting M laser beams emitted from said M semiconductor lasers toward said recording medium;

a scanning means for scanning said deflected M laser beams on said recording medium at a predetermined distance between one another simultaneously in a main scanning direction by controlling said deflector; and an exposing means for exposing said recording information on said recording medium through said scanning means and said transporting means, each of said pixel data in said recording information being represented by a recording pattern of pixel matrix comprising $N\times L$ micro pixels, N being an integral number from two to twenty representing the number of micro pixels with respect to said main scanning direction, L being a multiple number of M from one time to sixteen times representing the number of micro pixels with respect to said sub-scanning direction, said exposing means for controlling said emission of each of M semiconductor lasers in order to vary said recording pattern according to said density data to record half-tone, and a distance between each of said micro pixels in said sub-scanning direction being equal to said predetermined distance between each of said deflected M laser beams on said recording medium.

2. An apparatus according to claim 1 wherein L is equal to M.

3. An apparatus according to claim 1, wherein said exposing means exposes said recording pattern from micro pixels in a central area of said pixel matrix with respect to said sub-scanning direction with first priority, according to an elevation of said density data.

4. An apparatus according to claim 1, wherein said exposing means exposes said recording pattern from central micro pixels in said sub-scanning direction with respect to said main scanning direction and then micro pixels adjacent to said central micro pixels with respect to said main scanning direction, according to an elevation of said density data.

5. An apparatus according to claim 1, wherein said converting means converts an image information into a recording information comprising a plurality of pixel data each having a multi-level density data.

6. An apparatus according to claim 1, wherein said converting means converts an image information into a recording information comprising a plurality of pixel data each having a binary density data.

7. A recording apparatus for generating an image, comprising:

a rotatable recording medium having a cylindrical shape with a longitudinal axis and a circumference, said recording medium having a photosensitive surface, said recording medium having a main scanning direction parallel to the longitudinal axis and a sub-scanning direction parallel to the circumference;

a semiconductor laser array generating a plurality of laser beams (M) aimed at the recording medium along the sub-scanning direction;

an image forming means for forming the laser beams on the recording medium in a two-dimensional pixel pattern of micro-pixels forming a half tone pattern, said pixel pattern having rows (L) and columns (N), said number of rows (L) is an integral multiple of the number of laser beams (M);

recording medium rotating means for rotating the recording medium about the longitudinal axis at a recording medium rate;

deflecting means for deflecting the laser beams toward the recording medium; and a deflecting rotating means for rotating the deflecting means at a deflecting rate corresponding to the recording medium rate, said pixels pattern being deflected across the main scanning direction of the recording medium completing each main scanning direction line of the image until a complete photoelectric image is formed on the recording medium representing the image.

8. A recording apparatus according to claim 7, wherein the image forming means comprises:

an anamorphic lens having in which focal distances differ along the main scanning direction and the sub-scanning direction, said anamorphic lens creating the two-dimensional pixel pattern;

9. A recording apparatus according to claim 7, further comprising:

focusing means for focussing the laser beams.

10. A recording apparatus according to claim 9, wherein the focussing means comprises:

a collimator lens for collimating the laser beams;

a cylinder lens receiving the collimated laser beams and directing the laser beams onto the deflecting means, said deflecting means deflects the laser beams through the image forming means, and the image forming means forms the pixel pattern on the recording medium.

11. A recording apparatus according to claim 7, wherein the deflecting means is a polygonal mirror.

12. A recording apparatus according to claim 7, wherein the number of laser beams (M) and the number of rows (L) are set to three and the number of columns (N) is set to three, said laser beams including an upper, center and lower laser beam, the center laser beam impinging on the recording medium at a normal angle and a micro-pixel resulting from the center laser beam not distorted by curvature.

13. A recording apparatus according to claim 12, further comprising:

a pixel pattern scheme for mapping the pixel pattern for each pixel density, said pixel pattern scheme forming said micro-pixels with the center laser beam for lower densities, wherein said images having low densities will be formed using mostly the center laser beam, which is normal to the recording medium, and the low density image is not distorted by curvature.

14. A recording apparatus according to claim 7, wherein the number of laser beams (M) and the number of rows (L) are set to five and the number of columns (N) is set to three, said laser beams including central laser beams located in a region of the center rows of the pixel pattern, the central laser beams impinging on the recording medium at a normal angle and a micro-pixel resulting from the central laser beams not being distorted by curvature.

15. A recording apparatus according to claim 14, further comprising:

a pixel pattern scheme for mapping the pixel pattern for each pixel density, said pixel pattern scheme forming said micro-pixels with the central laser beams for low density images, said low density images being formed using the central laser beams, being normal to the recording medium, the low density image not being distorted by curvature.

* * * * *